United States Patent [19]

Shannon et al.

[11] 4,210,847

[45] Jul. 1, 1980

[54] ELECTRIC WIND GENERATOR

[75] Inventors: Roger L. Shannon, Federal Way; Dale F. Watkins, Sumner, both of Wash.; John T. Pogson, San Jose, Calif.

[73] Assignee: The United States of America as represented by the Secretary of the Navy, Washington, D.C.

[21] Appl. No.: 974,154

[22] Filed: Dec. 28, 1978

[51] Int. Cl.[2] ..... H05H 1/00

[52] U.S. Cl. ..... 315/111.9; 313/359

[58] Field of Search ..... 315/111, 111.1, 111.8, 315/111.9; 313/231, 359, 362; 250/324

[56] References Cited

U.S. PATENT DOCUMENTS

| | | | |
|---|---|---|---|
| 2,765,975 | 10/1956 | Lindenblad | 315/111.9 |
| 3,054,553 | 9/1962 | White | 315/111.9 |
| 3,212,442 | 10/1965 | Jorgenson et al. | 313/231 |
| 3,361,337 | 1/1968 | Hurst | 315/111.9 |
| 3,374,941 | 3/1968 | Okress | 315/111.9 |
| 3,638,058 | 1/1972 | Fritzius | 313/359 |

*Primary Examiner*—Eugene R. LaRoche

*Attorney, Agent, or Firm*—R. S. Sciascia; L. I. Shrago; C. E. Vautrain, Jr.

[57] ABSTRACT

A device for generating an air jet without the use of moving parts is provided. High voltage is used to create a corona discharge electric wind in a ducted, compact, portable generator that can be used for augmentation cooling applications where high voltage is available.

8 Claims, 4 Drawing Figures

ELECTRIC WIND GENERATOR

The present invention concerns apparatus for generating a flow of air and, more particularly, a portable device for generating an air jet from corona discharge.

The use of electrostatic fields to increase heat transfer is well known, however, much of the effort thus far has been directed to concentric cylindrical devices having a heated wire mounted horizontally therein whereby the wire cooling rate is increased by applying a high voltage to the wire. A non-uniform electric field established near a heated surface also increases the cooling rate. Heat transfer rate in condensation and evaporation processes are also increased by the presence of non-uniform electric fields. In complex avionics equipment, and electronic gear in general, heat transfer is required often from remotely positioned components. Efficient cooling devices for removing heat from these and other components in such equipment is desirable and in many instances essential since the reliability of these electronic components is inversely related to the level of undissipated heat generated thereby. The present invention provides a small, portable device capable of directing a jet air stream into and within such components, by means of the ionic wind phenomenon, which avoids the need for moving parts in the cooling apparatus.

Accordingly, it is an object of the present invention to provide a portable device for generating an air jet without requiring the use of moving parts.

Another object of the invention is to provide a portable device for generating an air jet from corona discharge.

A further object of the invention is to provide a portable corona discharge electric wind generator in which momentum transfer from ions to neutral air molecules produces an airflow which exits the device in the form of an air jet.

Other objects, advantages and features of the invention will become apparent from the following detailed description thereof when considered in conjunction with the accompanying drawing in which like numerals represent like parts throughout and wherein.

The invention, in general, comprises an ionic wind generator which provides a corona-discharge-generated air jet from a ducted probe with the discharge established at the tip of the probe by the application of high voltage thereto, producing ions which are accelerated toward a grounded screen. Corona discharge currents ranging from 0.08 to 24 microamperes and a probe spacing-to-duct ratio of from 0.088 to 1.41 produce or generate an air jet having a velocity on the order of from 500 ft./min in a probe having duct dimensions on the order of from 3.5 to 8.0 cm. in length and 2.5 to 4.0 cm. in diameter.

Figure 1:
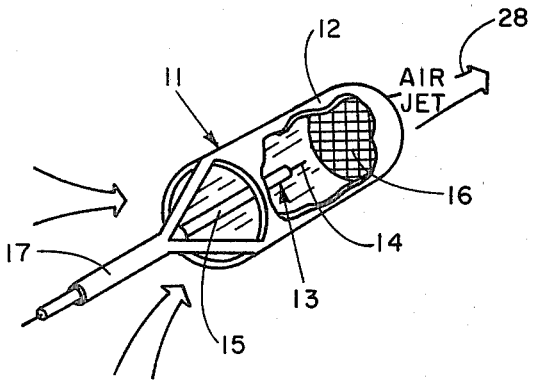
FIG. 1 is a schematic view partly cut away of a preferred embodiment of the invention.
Figure 2:
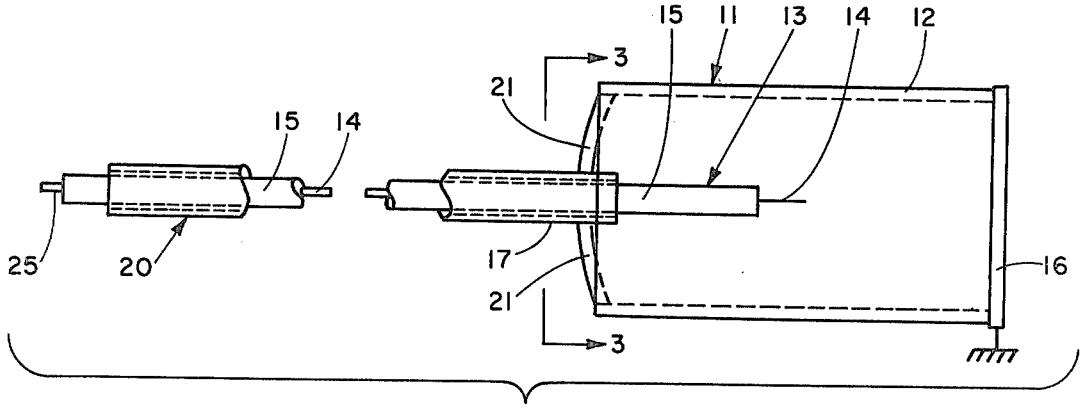
FIG. 2 is a front elevation partly cut away of the embodiment of FIG. 1.
Figure 3:
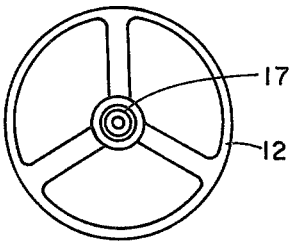
FIG. 3 is a sectional view of the preferred embodiment taken along a line substantially corresponding to line 3—3 in FIG. 2.
Figure 4:
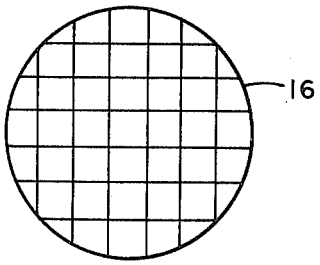
FIG. 4 is a front elevation of the grounded screen of the preferred embodiment.

Referring to the drawing, FIG. 1 shows a preferred embodiment of the invention which includes an ionic wind generator 11 having a duct 12 in which is centrally positioned a probe 13 and at the end thereof a grounded screen 16 for producing a maximum flow of ions from the probe to the screen. Probe 13 preferably includes a tungsten wire 14 mounted in a teflon tube 15 which is sealed in a glass tube 17. It will be appreciated that these components may be made of other suitable materials within the concept of the invention. FIG. 2 shows generator 11 in greater detail and with probe 13 broken at 20 to indicate that it may be varied in length to meet the requirements of particular applications. Tube 17, containing and supporting probe 13, is centered and secured in generator 11 by a plurality of brackets 21. FIG. 3 is a sectional view illustrating how the probe may be supported in duct 12, and FIG. 4 shows a typical grid structure for screen 16. Duct 12 is made of glass in the preferred embodiment, however, it also may be made of other suitable materials such as ceramics within the inventive concept.

In operation, high voltage applied at the exposed end 25 of wire 14 causes a corona discharge to be established at the tip thereof within duct 12, producing ions which are accelerated toward grounded screen 16. Ion collisions with the surrounding air molecules in duct 12 produce airflow through the duct which exits therefrom in the form of a jet as indicated at 28. In the preferred small scale embodiment of the invention, a high voltage supplied by a conventional 0-to 20-K v d-c supply, not shown, can produce air jet velocities on the order of 500 ft. min. The air-jet characteristics of the airflow have been verified by velocity measurements at various distances downstream of the ducted probe. The total airflow rate through the duct is found by integrating the velocity profile at the duct exit. The airflow rate is correlated with the corona discharge current and the probe geometry by the following expression:

$$Q=0.095(II)^{\frac{1}{2}}D\,(1-e^{-1.85I^{1/2}l/D})\ \text{CFM} \qquad (1)$$

where

I = current in microamperes l = probe to screen spacing in cm

D = duct diam. in cm

A corona discharge current of substantially 24 microamperes and a probe spacing to duct diameter ratio of substantially 1.141 generates the substantially 500 ft./min jet velocity. The applied voltage is correlated to the discharge current by the following expression:

$$V=1.5+0.422(II)^{1/2}(1+6.74\ I/D)\ \text{KV} \qquad (2)$$

The first term of this expression is the breakdown voltage, and the second term is believed to be related to the voltage dependence for a point source discharge in which the voltage is proportional to the square root of the produce of radial distance and current.

The foregoing data were limited to a maximum discharge current of about 20 microamperes. The air temperature ranged from 21° to 29° C. (70° to 85° F.) and the relative humidity from 20 to 50%. Humidity effects are relatively minor until the relative humidity increases to beyond 95%.

The invention thus provides a means for producing an air jet from corona discharge which can be used to augment cooling applications, especially in remote and/or limited access areas. The device is advantageous over conventional cooling techniques by reason of reliability and low weight, and over bare probe corona-discharge-electric-wind devices by the ducted probe configuration which produces a directed air jet and is operated independently from the surface being cooled. The air flow rate can be correlated to the corona discharge current, duct diameter and probe-to-screen spacing by expression (1).

What is claimed is:

1. A portable device for generating an air jet from corona discharge comprising:

a housing made of dielectric material and means for positioning a high voltage probe therein, said positioning means including a centering tube extending axially outward from one end of said housing;

a metallic screen mounted across the end of said housing opposite said positioning means and means grounding said screen;

a high voltage source external to said housing and a probe connected to said source and terminating in said housing for creating a corona discharge at the probe end in said housing; and means insulating said probe from said centering tube, whereby said device may be held by said centering tube and an air jet generated by a flow of ions from said probe end to said screen may be selectively directed for cooling, venting or other purposes.

2. The device of claim 1 wherein the air flow rate through said housing is controlled by corona discharge current and housing and probe geometry according to the expression $$Q=0.095\ (Il)^{\frac{1}{2}}D\ (1-e^{-1.85I^{\frac{1}{2}}l/D})\ \text{CFM}$$

where

I=current in microamperes l=probe to screen spacing in cm

D=housing diameter in cm and where the ratio of probe to screen spacing to housing diameter is substantially 1.141.

3. The device of claim 2 wherein a corona discharge current of substantially 24 microamperes produces a jet velocity of substantially 500 ft./min. at a voltage correlated to the discharge current by the expression $$V=1.5+0.422\ (Il)^{\frac{1}{2}}\ (1+6.74\ l/D)\ \text{KV},$$

said housing and said centering tube made of glass and said insulating means made of teflon.

4. An ionic wind generator for providing a corona-discharge-generated air jet comprising:

a cylindrical duct made of dielectric material and a high voltage probe extending axially thereinto and terminating therein;

a grounded metallic screen at the air discharge end of said duct and insulating means supporting said probe in said duct at the opposite end thereof, said insulating means extending beyond said duct a sufficient distance to afford holding said generator and directing the air jet as desired; and a high voltage source connected to said probe remote from said insulating means, said probe end in said duct adapted for corona discharge, whereby said device may be held by said insulating means and an air jet generated by flow of ions from said probe to said screen may be selectively directed for cooling, venting or other purposes.

5. The ionic wind generator of claim 4 wherein said insulating means includes an inner insulator around said probe and an outer insulator around said inner insulator for permitting handling of said generator, said outer insulator including means centering and securing said insulating means and said probe in said generator.

6. The ionic wind generator of claim 5 wherein the relationship of the distance between said screen and the end of said probe to the diameter of said duct is substantially 1.141 to effect an optimum air jet.

7. The ionic wind generator of claim 6 wherein said duct and said outer insulator are made of glass and said inner insulator is made of teflon, the flow rate of said air jet controlled by corona discharge current and duct and probe geometry according to the expression $$Q=0.095\ (Il)^{\frac{1}{2}}D\ (1-e^{-1.85I^{\frac{1}{2}}l/D})\ \text{CFM}$$

where

I=current in microamperes l=probe to screen spacing in cm

D=housing diameter in cm.

8. The ionic wind generator of claim 7 wherein corona discharge current, jet velocity and voltage are correlated by the expression $$V=1.5+0.422\ (Il)^{\frac{1}{2}}\ (1+6.74\ l/D)\ \text{KV}.$$

* * * * *